US009689619B2

(12) United States Patent
Matsuda et al.

(10) Patent No.: US 9,689,619 B2
(45) Date of Patent: Jun. 27, 2017

(54) HEAT EXCHANGER, REFRIGERATION CYCLE APPARATUS INCLUDING HEAT EXCHANGER AND AIR-CONDITIONING APPARATUS

(71) Applicant: Mitsubishi Electric Corporation, Tokyo (JP)

(72) Inventors: Takuya Matsuda, Tokyo (JP); Akira Ishibashi, Tokyo (JP); Sangmu Lee, Tokyo (JP); Takashi Okazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 208 days.

(21) Appl. No.: 14/394,864

(22) PCT Filed: Apr. 23, 2013

(86) PCT No.: PCT/JP2013/061878
§ 371 (c)(1),
(2) Date: Oct. 16, 2014

(87) PCT Pub. No.: WO2013/161799
PCT Pub. Date: Oct. 31, 2013

(65) Prior Publication Data

US 2015/0059401 A1 Mar. 5, 2015

(30) Foreign Application Priority Data

Apr. 26, 2012 (WO) ..... PCT/JP2012/002872

(51) Int. Cl.
*F25B 39/02* (2006.01)
*F28D 7/16* (2006.01)
(Continued)

(52) U.S. Cl.
CPC ..... *F28D 7/16* (2013.01); *F25B 1/005* (2013.01); *F25B 39/00* (2013.01); *F25B 39/028* (2013.01);
(Continued)

(58) Field of Classification Search
CPC ..... F28D 7/16; F28D 1/05391; F25B 1/005; F25B 39/00; F25B 39/028; F25B 39/04; F28F 1/022; F28F 9/0204
See application file for complete search history.

(56) References Cited

U.S. PATENT DOCUMENTS 5,314,013 A 5/1994 Tanabe
2003/0066633 A1* 4/2003 Lee ..... F25B 39/02 165/144
(Continued)

FOREIGN PATENT DOCUMENTS

CN 1410738 A 4/2003
CN 101133372 A 2/2008
(Continued)

OTHER PUBLICATIONS

Office Action dated Nov. 4, 2015 issued in corresponding CN patent application No. 201380025208.2 (and English translation).
(Continued)

*Primary Examiner* — Elizabeth Martin
(74) *Attorney, Agent, or Firm* — Posz Law Group, PLC

(57) ABSTRACT

A heat exchanger includes a plurality of heat exchange units each including a plurality of fins arranged at intervals such that air passes between adjacent fins and a plurality of heat transfer tubes through which a refrigerant flows. The heat transfer tubes extend through the fins in a direction of arrangement of the fins. The heat transfer tubes are arranged at multiple levels in a level direction perpendicular to an air passing direction. The heat exchange units are arranged in
(Continued)

multiple rows in a row direction, serving as the air passing direction. The heat exchanger further includes a row straddling header. Refrigerant passages are provided such that the refrigerant flowing from inlets of the refrigerant passages turns in the row straddling header to outlets of the refrigerant passages. The row straddling header has an interior separated into a plurality of chambers arranged in the level direction. The refrigerant passage is isolated for its corresponding chamber.

12 Claims, 7 Drawing Sheets

(51) Int. Cl.

| | |
|---|---|
| ***F28F 9/02*** | (2006.01) |
| ***F28D 1/053*** | (2006.01) |
| ***F28F 1/02*** | (2006.01) |
| ***F25B 1/00*** | (2006.01) |
| ***F25B 39/04*** | (2006.01) |
| ***F25B 39/00*** | (2006.01) |

(52) U.S. Cl.
CPC ..... *F25B 39/04* (2013.01); *F28D 1/05391* (2013.01); *F28F 1/022* (2013.01); *F28F 9/0204* (2013.01); *F25B 2339/02* (2013.01); *F25B 2339/04* (2013.01)

(56) References Cited

U.S. PATENT DOCUMENTS

| | | | | |
|---|---|---|---|---|
| 2005/0217838 | A1* | 10/2005 | Katoh | F28F 17/005 165/176 |
| 2009/0114379 | A1 | 5/2009 | Lim et al. | |
| 2010/0050685 | A1* | 3/2010 | Yanik | F25B 39/00 62/515 |
| 2011/0100614 | A1 | 5/2011 | Oh et al. | |

FOREIGN PATENT DOCUMENTS

| | | | |
|---|---|---|---|
| DE | 19719256 | A1 | 11/1998 |
| EP | 0 654 645 | A2 | 5/1995 |
| FR | 2864215 | A1 | 6/2005 |
| JP | 60-38364 | U | 3/1985 |
| JP | H04-187991 | A | 7/1992 |
| JP | H06-300477 | A | 10/1994 |
| JP | H09-33189 | A | 2/1997 |
| JP | H09-145187 | A | 6/1997 |
| JP | 11-237198 | A | 8/1999 |
| JP | 2001-272119 | A | 10/2001 |
| JP | 2003-75024 | A | 3/2003 |
| JP | 2003-214795 | A | 7/2003 |
| JP | 2005-265263 | A | 9/2005 |
| JP | 2005-321137 | A | 11/2005 |
| JP | 2006-308148 | A | 11/2006 |
| JP | 2008-528946 | A | 7/2008 |

OTHER PUBLICATIONS

Office Action mailed Apr. 12, 2016 issued in the corresponding JP patent application No. 2015-133722 (and English translation).
Office Action issued May 19, 2016 issued in the corresponding CN patent application No. 201380025208.2 (and English translation).
International Search Report of the International Searching Authority mailed Jul. 16, 2013 for the corresponding international application No. PCT/JP2013/061878 (and English translation).
Office Action mailed Jul. 14, 2015 issued in corresponding JP patent application No. 2014-512600 (and English translation).
Extended European Search Report (EESR) of the European Patent Office dated Feb. 29, 2016 in corresponding EP Application No. 13 78 0638.
Office Action dated Nov. 14, 2016 issued in the corresponding CN patent application No. 201380025208.2 (and English translation).

* cited by examiner (a)

(b)

HEAT EXCHANGER, REFRIGERATION CYCLE APPARATUS INCLUDING HEAT EXCHANGER AND AIR-CONDITIONING APPARATUS

CROSS REFERENCE TO RELATED APPLICATIONS

This application is a U.S. national stage application of PCT/JP2013/061878 filed on Apr. 23, 2013, which claims priority to international application no. PCT/JP2012/002872, filed on Apr. 26, 2012, the contents of which are incorporated herein by reference.

TECHNICAL FIELD

The present invention relates to a heat exchanger included in a refrigeration cycle apparatus, such as an air-conditioning apparatus, a refrigeration cycle apparatus including the heat exchanger and an air-conditioning apparatus.

BACKGROUND

This kind of heat exchanger includes a plurality of passages. A refrigerant is evenly distributed (or divided into streams) to the passages in order to improve the performance of heat transfer of the heat exchanger. A technique has recently been developed to arrange a plurality of heat exchange units, each including a plurality of fins and a plurality of flat tubes, in a row direction which serves as an air passing direction, in which air passes through the heat exchange units, in order to further increase the efficiency of heat exchange (see, Patent Literature 1, for example).

In Patent Literature 1, first ends of the flat tubes of a first heat exchange unit are in communication with first ends of the flat tubes of a second heat exchange unit through a row straddling header. An inlet header evenly divides the refrigerant into streams, which flow through the flat tubes of the first heat exchange unit. The streams temporarily merge into a stream of the refrigerant in the row straddling header, the refrigerant turns to the second heat exchange unit, the refrigerant is again divided into streams which flow through the flat tubes of the second heat exchange unit, the streams merge into a stream of the refrigerant in an outlet header, and the refrigerant flows out of the outlet header.

PATENT LITERATURE

Patent Literature 1: Japanese Unexamined Patent Application Publication No. 2003-75024 (Abstract, FIG. 1)

In Patent Literature 1, the refrigerant is evenly divided into streams which flow through the flat tubes of the first heat exchange unit and the streams temporarily merge into a stream of the refrigerant in the row straddling header. Accordingly, an initial evenly divided state is not maintained. Disadvantageously, uneven distribution of the refrigerant to the flat tubes of the second heat exchange unit results in a reduction in heat exchange efficiency of the heat exchanger.

SUMMARY

The present invention has been made in consideration of the above-described disadvantage. An object of the present invention is to provide a heat exchanger including a plurality of heat exchange units arranged in an air passing direction in which air passes through the heat exchange units, the heat exchanger being capable of reducing uneven division of a refrigerant flowing from inlets of refrigerant passages to outlets thereof and thus exhibiting improved heat exchange performance, to provide a refrigeration cycle apparatus including the heat exchanger and to provide an air-conditioning apparatus.

The present invention provides a heat exchanger including a plurality of heat exchange units each including a plurality of heat transfer tubes through which a refrigerant in a gas-liquid two-phase state flows and a plurality of fins arranged such that air passes between adjacent fins in an air passing direction, the heat transfer tubes being arranged at multiple levels in a level direction perpendicular to the air passing direction, the heat exchange units being arranged in multiple rows in a row direction, serving as the air passing direction. The heat exchanger further includes a row straddling header. The heat exchange units at opposite ends in the row direction of the heat exchange units arranged in the multiple rows serve as an inlet heat exchange unit into which the refrigerant flows and an outlet heat exchange unit out of which the refrigerant flows. First ends of the heat transfer tubes being arranged at the multiple levels of adjacent heat exchange units in the row direction of the heat exchange units arranged in the multiple rows are in communication with the row straddling header to provide refrigerant passages through which the refrigerant flows such that the refrigerant flowing from inlets of the heat transfer tubes being arranged at the multiple levels of the inlet heat exchange unit turns in the row straddling header to outlets of the heat transfer tubes being arranged at the multiple levels of the outlet heat exchange unit. The row straddling header has an inner space separated into a plurality of chambers arranged in the level direction and the refrigerant passage is isolated for each chamber.

According to the present invention, the heat exchanger is capable of reducing uneven division of the refrigerant throughout the passages because an evenly divided state at an inlet of the heat exchanger is maintained to an outlet thereof, thus exhibiting improved heat exchange performance.

DETAILED DESCRIPTION

Figure 1:
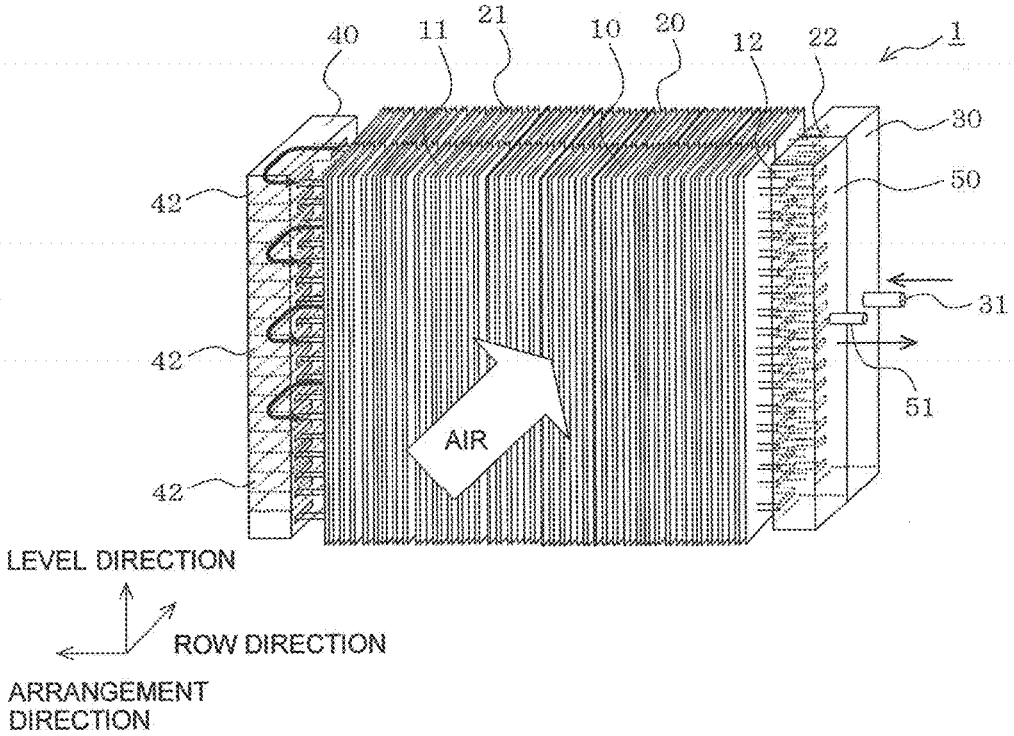
FIG. 1 is a perspective view of a heat exchanger according to Embodiment of the present invention.
Figure 2:
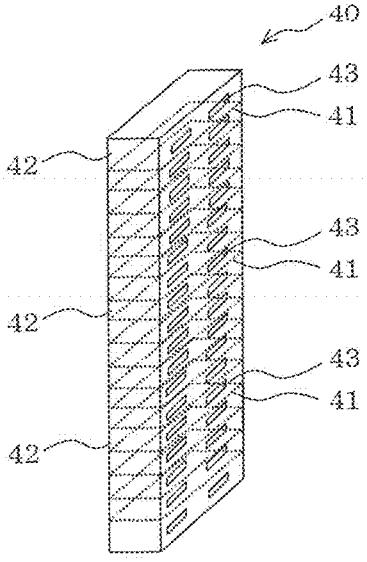
FIG. 2 is a perspective view of a row straddling header in FIG. 1.

FIG. 1 is a perspective view of a heat exchanger according to Embodiment of the present invention. FIG. 2 is a perspective view of a row straddling header in FIG. 1. Components in FIGS. 1 and 2 and other figures, which will be described later, designated by the same reference numerals are the same or equivalent components, which are common throughout the specification. Furthermore, components depicted herein are illustrative and representative and are not meant to be limiting.

A heat exchanger 1 includes a first heat exchange unit 10 and a second heat exchange unit 20 arranged in a row direction, serving as an air passing direction in which air passes through the heat exchanger 1, an inlet header 30 that serves as a refrigerant divider, a row straddling header 40, and an outlet header 50.

Figure 3:
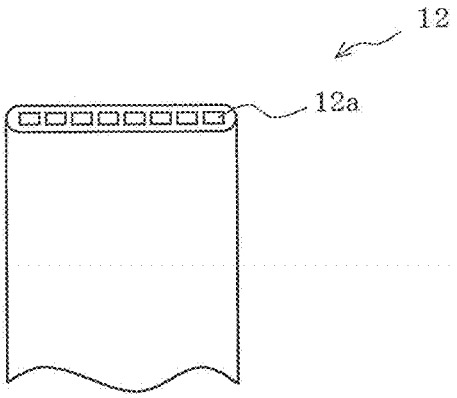
FIG. 3 is a perspective view of a flat tube in FIG. 1.

The first heat exchange unit (outlet heat exchange unit) 10 includes a plurality of fins 11 arranged at regular intervals such that air passes between adjacent fins 11, and a plurality of flat tubes (heat transfer tubes) 12, through which a refrigerant flows, extending through the fins 11 in a direction of arrangement of the fins 11. The flat tubes 12 are arranged at multiple levels in a level direction perpendicular to the air passing direction. Each flat tube 12 has a plurality of through-holes 12*a*, serving as a refrigerant passage, as illustrated in FIG. 3. The second heat exchange unit (inlet heat exchange unit) 20 has the same configuration as that of the first heat exchange unit 10 and includes a plurality of fins 21 and a plurality of flat tubes (heat transfer tubes) 22. Although the fin 11 illustrated herein is plate-shaped, the fin does not necessarily have to be a plate-shaped fin. For example, wavy fins may be arranged such that the flat tubes 12 and the fins are alternately arranged in the level direction. It is only required that the fins be arranged to allow air to pass between the fins in the air passing direction.

The inlet header 30 is disposed adjacent to one end of the second heat exchange unit 20 so as to extend in the level direction. The inlet header 30 is in communication with all of the flat tubes 22 of the second heat exchange unit 20. The inlet header 30 evenly divides the refrigerant flowing from a refrigerant inlet pipe 31 into streams and allows the streams to flow through the flat tubes 22.

The outlet header 50 is disposed adjacent to one end of the first heat exchange unit 10 so as to extend in the level direction. The outlet header 50 is in communication with all of the flat tubes 12 of the first heat exchange unit 10. The outlet header 50 combines the refrigerant streams having passed through the flat tubes 12 into a single stream of the refrigerant and allows the refrigerant to flow through a refrigerant outlet pipe 51.

The row straddling header 40 is disposed adjacent to the other end of each of the first and second heat exchange units 10 and 20 so as to extend in the level direction and straddle across the first and second heat exchange units 10 and 20. The row straddling header 40 is hollow and has an interior separated by partitions 41 into a plurality of chambers 42 arranged in the level direction. The number of chambers 42 is equal to the number of levels at which the flat tubes 12 and 22 are arranged. Each chamber 42 is provided with two through-holes 43 to which the ends of the flat tubes 12 and 22 at the same level are connected. The chamber 42 with such a configuration functions as a return passage into which the refrigerant having passed through the flat tube 22 flows and in which this refrigerant turns to the flat tube 12 as indicated by each arrow in FIG. 1.

In the above-described configuration, a passage extending from an inlet of the flat tube 22 of the second heat exchange unit 20 to an outlet of the flat tube 12 of the first heat exchange unit 10 is isolated for each level (or each chamber 42).

The flat tubes 12 and 22, the fins 11 and 21, the inlet header 30, the row straddling header 40, and the outlet header 50 are made of, for example, aluminum or aluminum alloy.

To make the heat exchanger 1 with the above-described configuration, the flat tubes 12 and 22, the fins 11 and 21, the inlet header 30, the row straddling header 40, and the outlet header 50 are assembled and joined together by furnace soldering.

Figure 4:
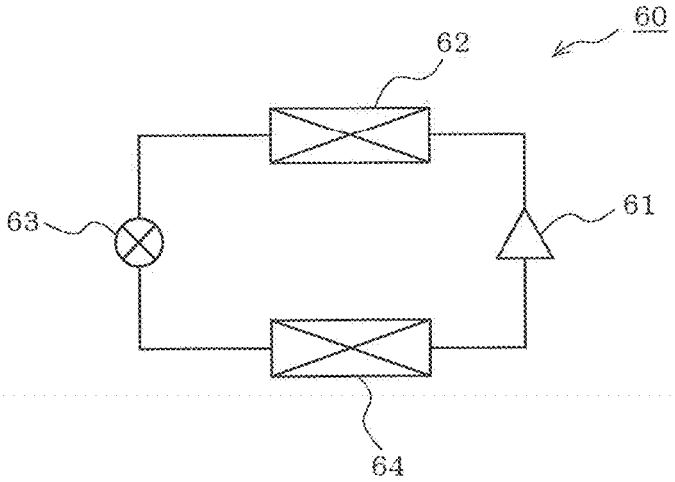
FIG. 4 is a diagram illustrating a refrigerant circuit of a refrigeration cycle apparatus including the heat exchanger 1 in FIG. 1.

FIG. 4 is a diagram illustrating a refrigerant circuit of a refrigeration cycle apparatus including the heat exchanger in FIG. 1.

A refrigeration cycle apparatus 60 includes a compressor 61, a condenser 62, an expansion valve 63, which serves as a pressure reducing device, and an evaporator 64. The heat exchanger 1 is used as at least one of the condenser 62 and the evaporator 64. The refrigerant discharged from the compressor 61 flows into the condenser 62, where the refrigerant exchanges heat with air passing through the condenser 62 and thus turns into a high-pressure liquid refrigerant. The refrigerant flows out of the condenser 62. The high-pressure liquid refrigerant leaving the condenser 62 is pressure-reduced by the expansion valve 63, so that the refrigerant turns into a low-pressure two-phase refrigerant. The refrigerant flows into the evaporator 64. The low-pressure two-phase refrigerant, which has flowed into the evaporator 64, exchanges heat with air passing through the evaporator 64 and thus turns into a low-pressure gas refrigerant. The refrigerant is again sucked into the compressor 61.

Figure 5:
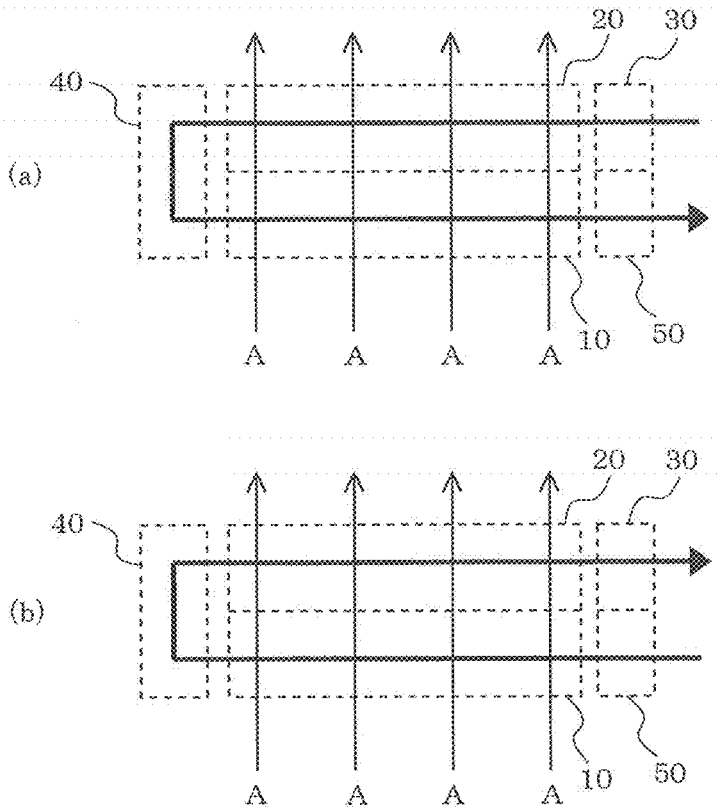
FIG. 5(*a*) is a diagram illustrating refrigerant flow (counter flow) in a case where the heat exchanger in FIG. 1 is used as a condenser and FIG. 5(*b*) is a diagram illustrating parallel flow.

FIG. 5(*a*) is a diagram illustrating flow of the refrigerant in a case where the heat exchanger in FIG. 1 is used as a condenser and illustrates the refrigerant flow when the heat exchanger in FIG. 1 is viewed in plan. In FIG. 5(*a*), a thick arrow indicates a refrigerant flow direction and thin arrows A indicate air flow.

When the heat exchanger 1 is used as the condenser 62, the refrigerant is allowed to flow from a downstream side to an upstream side in the air flow direction A in a return manner (hereinafter, this flow will be referred to as "counter flow"). On the other hand, as illustrated in FIG. 5(*b*), a way of allowing the refrigerant to flow from the upstream side to the downstream side in the air flow direction A in a return manner is called "parallel flow". The parallel flow will be described later.

The flow of the refrigerant in the case where the heat exchanger 1 is used as the condenser 62 will now be described with reference to FIGS. 1 and 4.

The refrigerant flows through the refrigerant inlet pipe 31 into the inlet header 30, where the refrigerant is evenly divided into streams and the refrigerant streams flow into the inlets of the flat tubes 22 of the second heat exchange unit 20. The refrigerant streams pass through the flat tubes 22 and flow into the chambers 42 of the row straddling header 40. Each refrigerant stream turns to and flows into the flat tube 12 in the chamber 42.

Each refrigerant stream, obtained by evenly dividing the refrigerant, flows into the chamber 42, flows out of the chamber 42 without mixing with the other refrigerant streams in the other chambers 42, and then flows into the flat tube 12 of the first heat exchange unit 10. Accordingly, the refrigerant streams flowing out of the chambers 42 flow into the flat tubes 12 while being maintained in an evenly divided state. The refrigerant streams having passed through the flat tubes 12 merge into a single stream of the refrigerant in the outlet header 50. The refrigerant flows through the refrigerant outlet pipe 51 to the outside. When the heat exchanger 1 is used as the condenser 62, the refrigerant can be easily divided evenly because the refrigerant in a gas state flows into the heat exchanger 1. Accordingly, the inlet header 30, serving as a refrigerant divider, may be omitted. A component whose interior communicates with the flat tubes 22 of the second heat exchange unit 20 may be used.

Advantages of flowing the refrigerant in counter flow will now be described. The advantages of the refrigerant counter flow are associated with a temperature distribution of the refrigerant in a refrigerant passage from an inlet to an outlet.

Figure 6:
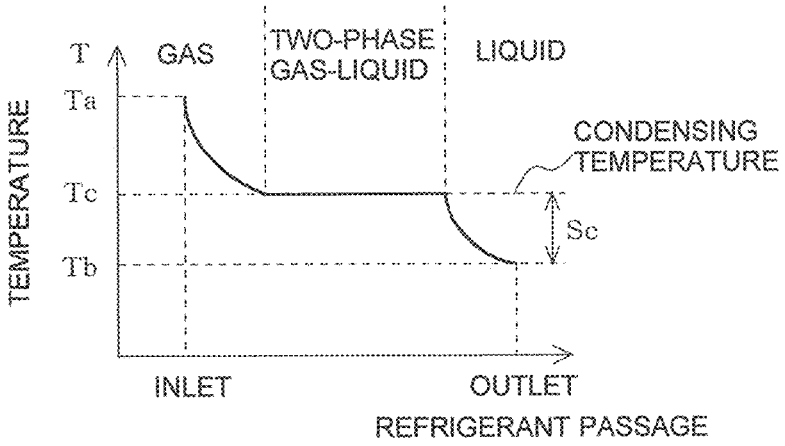
FIG. 6 includes graphs each illustrating a refrigerant temperature distribution in a refrigerant passage extending from an inlet to an outlet of a condenser.
Figure 6:
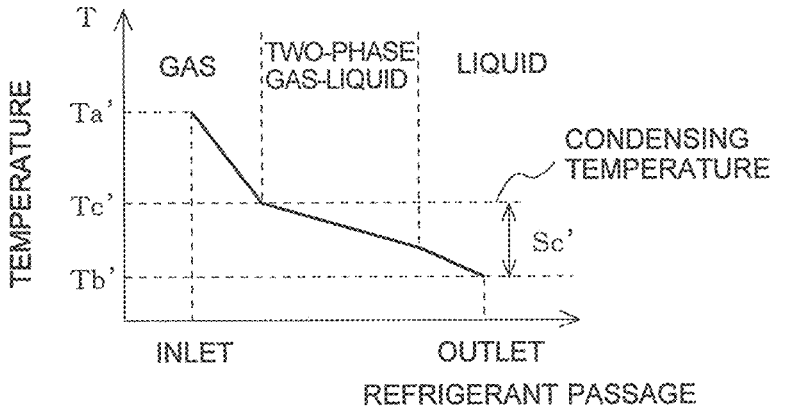

FIG. 6 includes graphs each illustrating the refrigerant temperature distribution in the refrigerant passage from an inlet to an outlet of a condenser. In FIG. 6, the axis of abscissas denotes the refrigerant passage and the axis of ordinates denotes the temperature. In FIG. 6, (a) indicates a case where the refrigerant is a single refrigerant, such as R32 or HFO1234YF, or an azeotropic refrigerant mixture, such as R410A, and (b) indicates a case where the refrigerant is a non-azeotropic refrigerant, such as a mixture of HFO1234YF and R32. The condenser 62 performs subcooling, indicated by SC (=Tc−Tb) in FIG. 6, to increase the heat exchange performance.

As regards the single refrigerant or the azeotropic refrigerant mixture, as illustrated in FIG. 6(*a*), the gas refrigerant at a high temperature Ta flows into the condenser 62 and exchanges heat with air passing through the condenser 62, so that the temperature of the refrigerant falls to a condensing temperature Tc. The refrigerant exhibits a two-phase gas-liquid state such that the temperature of the refrigerant is constant at the condensing temperature Tc, and then turns into a liquid state. The temperature of the refrigerant in the liquid state further falls to a low temperature Tb which is lower than the condensing temperature Tc, thus providing subcooling. The low-temperature refrigerant flows out of the condenser 62.

As regards the non-azeotropic refrigerant, as illustrated in FIG. 6(*b*), the gas refrigerant at a high temperature Ta' flows into the condenser 62 and exchanges heat with air passing through the condenser 62, so that the temperature of the refrigerant falls to a condensing temperature Tc'. The temperature of the non-azeotropic refrigerant in a two-phase gas-liquid state continues to fall because a gas saturation temperature thereof differs from a liquid saturation temperature thereof, so that the refrigerant turns into a liquid state. The temperature of the liquid refrigerant further falls to a low temperature Tb' which is lower than the condensing temperature Tc', thus providing subcooling. The low-temperature refrigerant flows out of the condenser 62.

The condenser 62 is required to provide subcooling of, for example, about 10 degrees C. It is therefore necessary to ensure a sufficient amount of heat exchanged with air in a latter half of each refrigerant passage from the inlet to the outlet of the condenser 62.

If the parallel flow (see FIG. 5(*b*)) is performed in the condenser 62, air which has exchanged heat with the refrigerant in the first heat exchange unit 10 flows through the second heat exchange unit 20. Accordingly, the difference in temperature between the air and the refrigerant in the latter half of each refrigerant passage would be insufficient. Unfortunately, intended subcooling could not be provided. On the other hand, in the counter flow, the refrigerant in the latter half of the refrigerant passage exchanges heat with air which is to exchange heat with the refrigerant. Consequently, a sufficient temperature difference can be achieved, so that stable subcooling can be provided.

Although the advantages of the counter flow in the condenser 62 are obtained in the use of a single refrigerant or an azeotropic refrigerant, the advantages are particularly enhanced in the use of a non-azeotropic refrigerant. Specifically, the non-azeotropic refrigerant in a two-phase gas-liquid state has a temperature glide because the gas saturation temperature differs from the liquid saturation temperature, as described above. Consequently, the temperature difference between the non-azeotropic refrigerant and air is larger than that between the azeotropic refrigerant and air. Thus, the advantages are enhanced.

In the above description, the heat exchanger 1 is used as the condenser 62. A case where the heat exchanger 1 is used as the evaporator 64 will now be described. Although either the counter flow or the parallel flow may be used when the heat exchanger 1 is used as the evaporator 64, the counter flow is preferable. In the case where the heat exchanger 1 is used as the evaporator 64, if the refrigerant is a non-azeotropic refrigerant, the refrigerant in a two-phase gas-liquid state has a temperature glide as described above and the temperature difference is accordingly increased, thus improving the heat exchange performance. Consequently, advantages of the counter flow are greater than those of the parallel flow.

The evaporator 64 provides superheat to increase the heat exchange performance. Typically, superheat which is about 1 or 2 degrees C. is less than subcooling which is 10 degrees C. Accordingly, advantages of the counter flow in the condenser 62 are greater than those in the evaporator 64.

If the heat exchanger 1 is exclusively used as an evaporator or a condenser, the configuration of FIG. 1 with the refrigerant counter flow may be used. If the refrigeration cycle apparatus 60 in FIG. 4 further includes a four-way valve to switch between refrigerant flow directions and the heat exchanger 1 is used as the evaporator 64 or the condenser 62 while alternating between functioning as the evaporator 64 and functioning as the condenser 62, the heat exchanger 1 may be configured as illustrated in FIG. 7.

Figure 7:
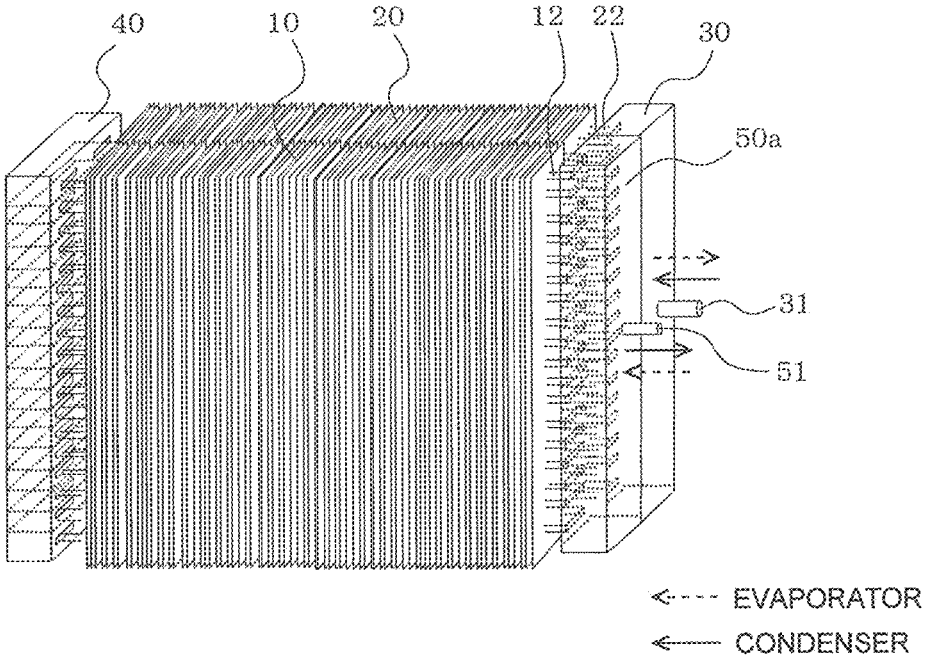
FIG. 7 is a diagram illustrating a heat exchanger used as an evaporator or a condenser while alternating between functioning as an evaporator and functioning as a condenser.

FIG. 7 is a diagram illustrating a heat exchanger that is used as an evaporator or a condenser selectively. In FIG. 7, dashed-line arrows indicate refrigerant flow in the evaporator 64 and solid-line arrows indicate refrigerant flow in the condenser 62.

The configuration of FIG. 7 differs from that of FIG. 1 in that an outlet header 50*a* functioning as a refrigerant divider to evenly divide the refrigerant into streams is disposed instead of the outlet header 50.

When the heat exchanger 1 with such a configuration is used as the evaporator 64, the parallel flow is provided, specifically, the refrigerant flows through the outlet header 50*a*, the first heat exchange unit 10, the row straddling header 40, the second heat exchange unit 20, and the inlet header 30 in that order. As described above, the refrigerant flows into the outlet header 50*a* when the heat exchanger 1 is used as the evaporator 64. Accordingly, the outlet header 50*a* is allowed to function as a refrigerant divider so that the refrigerant in a two-phase gas-liquid state which has flowed into the outlet header 50*a* is evenly divided into streams and the refrigerant streams flow into the respective flat tubes 12. On the other hand, when the heat exchanger 1 is used as the condenser 62, the counter flow is provided, specifically, the refrigerant flows through the inlet header 30, the second heat exchange unit 20, the row straddling header 40, the first heat exchange unit 10, and the outlet header 50*a* in that order.

According to Embodiment described above, the refrigerant stream passing through the flat tubes 12 and 22 at each level flows through the isolated refrigerant passage from the inlet to the outlet thereof in the first and second heat exchange units 10 and 20 without mixing with the other refrigerant streams at the other levels. Accordingly, the evenly divided state at the inlet is successfully maintained to the outlet, thus reducing uneven flow division. Consequently, the heat exchange efficiency of the heat exchanger 1 can be enhanced, thus achieving a highly efficient operation of the refrigeration cycle apparatus 60 including the heat exchanger 1.

When the heat exchanger 1 is used as the condenser 62, the refrigerant is allowed to flow in a counter flow manner, thus increasing the heat exchange efficiency. The advantages of the counter flow are significantly enhanced in the case where the refrigerant enclosed in the refrigeration cycle apparatus 60 is a non-azeotropic refrigerant.

The configuration of the heat exchanger according to the present invention is not limited to that illustrated in FIG. 1. Modifications and variations of Embodiment can be made without departing from the spirit and scope of the present invention as follows ((1) to (10), for example).

(1) Although the partition 41 is provided for each level in the row straddling header 40 in Embodiment, the partition 41 does not necessarily have to be provided for each level. It is only required that the interior of the row straddling header 40 be separated into a plurality of chambers arranged in the level direction in order to maintain the evenly divided state.

Specifically, whether the evenly divided state can be maintained depends on a head difference in each chamber 42. An interval between the partitions 41 may be determined in consideration of the head difference. Providing a minimum number of partitions 41 results in a reduction in cost.

(2) The positions of the partitions 41 may be determined depending on an air velocity distribution in the heat exchanger 1.

The velocity of air from an air-sending fan to supply air to the heat exchanger 1 is not uniform on the entire surface of the heat exchanger 1. There exists an air velocity distribution. For example, in a multi-air-conditioning apparatus for a building, an air-sending fan is disposed upstream of the heat exchanger 1. The air velocity in upper part of the heat exchanger is accordingly higher than that in lower part thereof. When the heat exchanger 1 is used as the evaporator 64, gasification in part with high air velocity is promoted more than that in part with low air velocity. The refrigerant is easily divided evenly in the part with high air velocity. In part of the row straddling header 40 which communicates with the flat tubes 12 and 22 extending in the part with high air velocity, therefore, the height (or length in the level direction) of each chamber 42 may be increased (or extended) by increasing the distance between the partitions 41.

Figure 8:
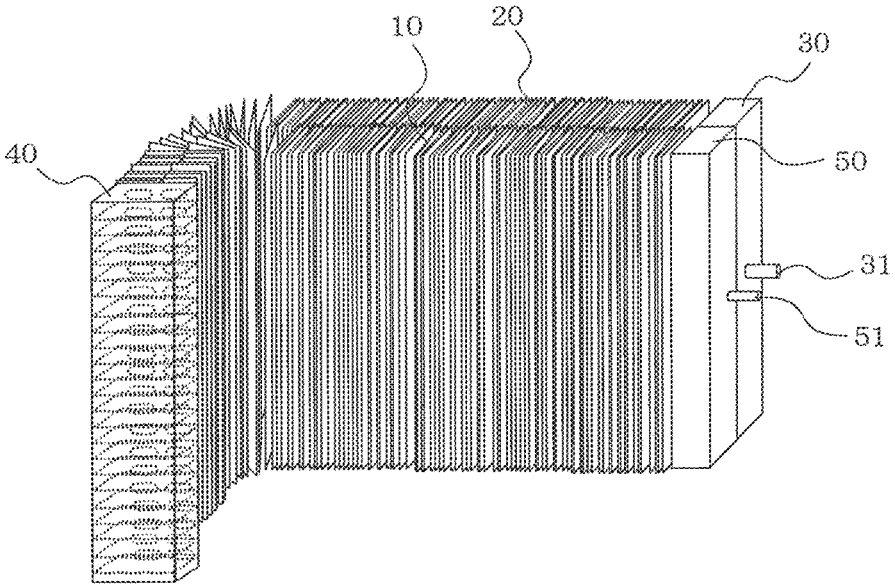
FIG. 8 is a diagram illustrating a heat exchanger formed in a generally L-shape.

(3) Although the heat exchanger 1 is generally I-shaped in Embodiment, the heat exchanger 1 may be generally L-shaped, as illustrated in FIG. 8, such that the heat exchanger 1 is partly bent.

Figure 9:
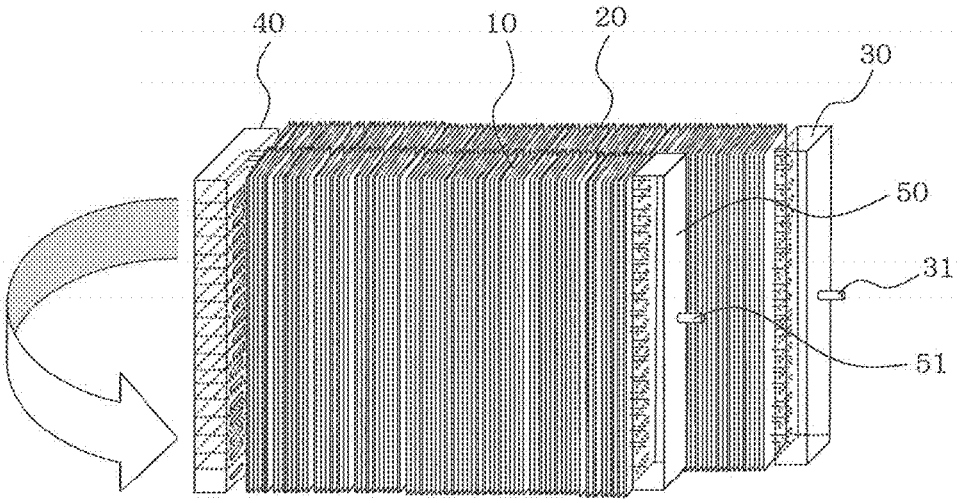
FIG. 9 is a diagram illustrating the heat exchanger in FIG. 8 in a state before bending.

A generally L-shaped heat exchanger can be formed by bending the generally I-shaped heat exchanger 1 in a direction indicated by an arrow in FIG. 9 into an L-shape. Of course, the first heat exchange unit 10 should be shorter than the second heat exchange unit 20 in a state before bending as illustrated in FIG. 9 so that ends of the first and second heat exchange units 10 and 20 on each side are aligned in an L-bent state. Aligning the ends of the first and second heat exchange units on each side facilitates arrangement of external pipes connected to the refrigerant inlet pipe 31 and the refrigerant outlet pipe 51.

Whether to form the heat exchanger 1 into an I-shape or an L-shape may be determined depending on a space for mounting the heat exchanger 1 in a casing that accommodates the heat exchanger 1. The shape may be determined so that the heat exchanger 1 can be mounted in an optimized mounting space at high density. The shape may be a U-shape or rectangular in addition to the I-shape and the L-shape. In any case, high-density placement in the mounting space allows for high heat exchange efficiency. In such a case, the heat exchanger 1 is configured such that the ends of the first and second heat exchange units 10 and 20 on each side are aligned.

(4) Although the configuration with the inlet header 30 as a refrigerant divider has been described above, the inlet header 30 may include an uneven flow division reducing member (for example, orifices to narrow the flow of the refrigerant) to reduce uneven flow division.

(5) As a refrigerant divider, a distributor to substantially evenly divide the refrigerant into streams may be disposed instead of the inlet header 30.

Figure 10:
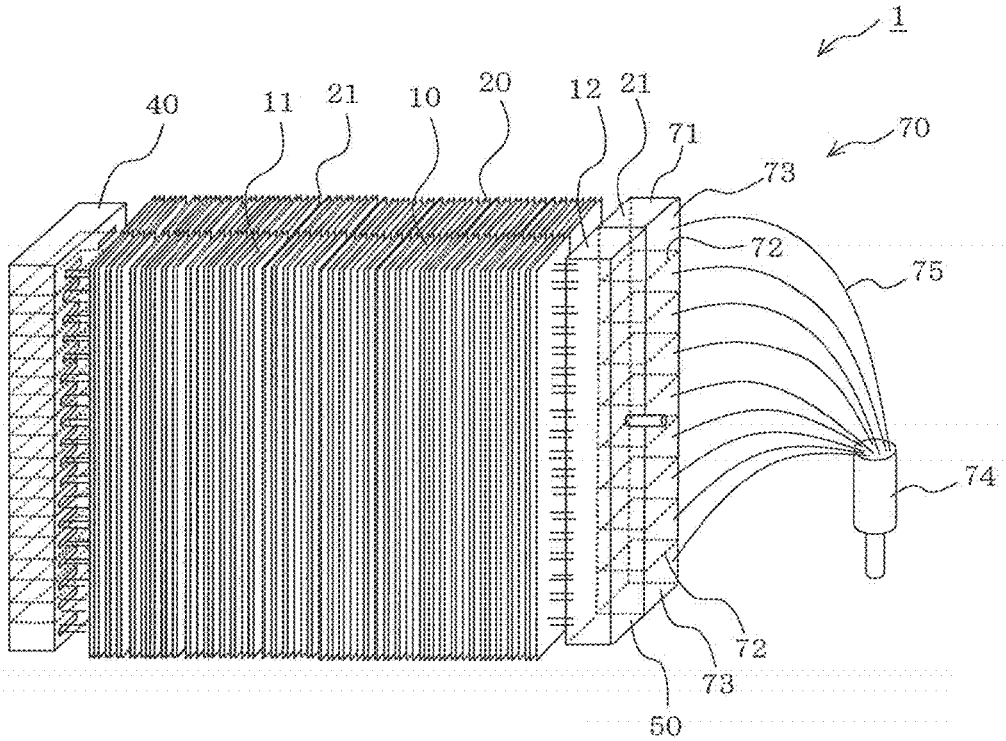
FIG. 10 is a diagram illustrating another configuration of a refrigerant divider.

(6) A refrigerant divider 70 illustrated in FIG. 10 may be used instead of the inlet header 30.

The refrigerant divider 70 includes a header 71 that communicates with an end of each flat tube 12 and a distributor 74. The header 71 has an interior separated by one or more partitions 72 into a plurality of chambers 73 arranged in a longitudinal direction of the header 71. Each chamber 73 is connected to the distributor 74 with a capillary tube 75. In the refrigerant divider 70, the distributor 74 substantially evenly divides the refrigerant into streams and the refrigerant streams flow through the capillary tubes 75 into the chambers 73.

Each chamber 73 has a longitudinal length less than that of the header 71 measured when the header 71 has a continuous interior without being separated by the partitions 72. This reduces the influence of a head difference due to gravity, so that the refrigerant can be evenly divided into streams and the refrigerant streams can be supplied to the flat tubes 22 communicating with the respective chambers 73. The partition 72 is preferably disposed not for each level, but every multiple levels, as illustrated in FIG. 10, in consideration of cost reduction and arrangement of the capillary tubes 75. The partition 72, however, may be disposed for each level.

(7) Although the configuration with the row straddling header 40 mounted longitudinally is illustrated in Embodiment, the entire heat exchanger 1 in FIG. 1 may be rotated by 90 degrees such that the row straddling header 40 is mounted laterally. In the configuration with the longitudinally mounted row straddling header 40, the effect of reducing the influence of the head difference is higher than that in the configuration with no partitions 41. Accordingly, advantages achieved by the present invention are enhanced in the configuration with the longitudinally mounted row straddling header 40.

(8) Although the heat exchange units arranged in two rows (two-row arrangement) are illustrated in Embodiment, the heat exchange units may be arranged in three or more rows. In such a case, the heat exchanger may be configured in a manner similar to the two-row arrangement. Specifically, the heat exchange units at opposite ends in the row direction of the heat exchange units arranged in multiple rows serve as an inlet heat exchange unit into which the refrigerant flows and an outlet heat exchange unit out of which the refrigerant flows. First ends of heat transfer tubes arranged at multiple levels of adjacent heat exchange units in the row direction of the heat exchange units arranged in the multiple rows are in communication with the row straddling header, thus providing refrigerant passages through which the refrigerant flows such that the refrigerant flowing from inlets of the heat transfer tubes being arranged at the multiple levels of the inlet heat exchange unit turns in the row straddling header to outlets of the heat transfer tubes being arranged at the multiple levels of the outlet heat exchange unit. The row straddling header has an interior separated into a plurality of chambers arranged in the level direction and the refrigerant passage is isolated for its corresponding chamber.

(9) Although each heat transfer tube is a flat tube in Embodiment, the heat transfer tube does not necessary have to be a flat tube. The heat transfer tube may be a cylindrical tube.

Figure 11:
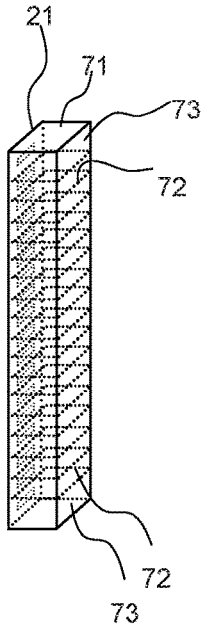
FIG. 11 is a perspective view of an inlet header separated into a plurality of chambers arranged in the level direction.
Figure 12:
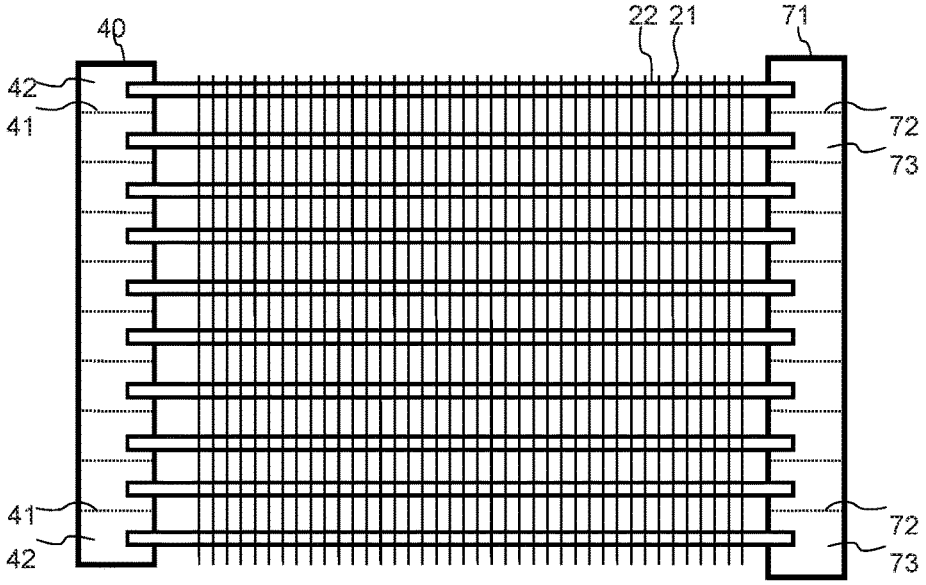
FIG. 12 is an elevation view illustrating each chamber in the inlet header which corresponds to each chamber in the row straddling header at the same level.

(10) The configuration in which each of the inlet header and the row straddling header has an interior separated into a plurality of chambers arranged in the level direction, and in which each of the refrigerant passages is isolated by corresponding chambers in the inlet header and the row straddling header, is illustrated in FIG. 11 and FIG. 12.

The invention claimed is:

1. A heat exchanger comprising:

a plurality of heat exchange units each including a plurality of heat transfer tubes through which a refrigerant in a gas-liquid two-phase state flows, and a plurality of fins arranged such that air passes between adjacent fins in an air passing direction, the heat transfer tubes being arranged at multiple levels in a level direction perpendicular to the air passing direction, the heat exchange units being arranged in multiple rows in a row direction that serves as the air passing direction; and a row straddling header in communication with the heat transfer tubes at first ends of the heat transfer tubes, wherein, the heat exchange units at opposite ends in the row direction of the heat exchange units arranged in the multiple rows serve as an inlet heat exchange unit into which the refrigerant flows, and an outlet heat exchange unit out of which the refrigerant flows, the inlet heat exchange unit having an inlet header in communication with the heat transfer tubes at second ends of the heat transfer tubes, the inlet header, the heat transfer tubes and an outlet header define refrigerant passages through which the refrigerant flows, and each of the inlet header and the row straddling header has an interior separated into a plurality of chambers arranged in the level direction, each of the refrigerant passages being isolated by corresponding chambers in the inlet header and the row straddling header.

2. The heat exchanger of claim 1, wherein the inlet heat exchange unit is disposed in most downstream in the air passing direction and the outlet heat exchange unit is disposed in most upstream in the air passing direction.

3. The heat exchanger of claim 2, wherein the heat exchanger is configured for selective use as an evaporator or a condenser.

4. The heat exchanger of claim 1, wherein the row straddling header is separated at the multiple levels of the heat transfer tubes into the chambers and each isolated passage is provided for the heat transfer tubes at the same level.

5. The heat exchanger of claim 1, wherein each chamber has, in the level direction, a length determined depending on an air velocity distribution.

6. The heat exchanger of claim 1, wherein the heat transfer tubes arranged at the multiple levels are bent in a horizontal direction, and ends of the heat exchange units arranged in the multiple rows on each side are aligned.

7. The heat exchanger of claim 1, wherein the header includes an uneven flow division reducing member disposed in refrigerant inlet part of the header.

8. The heat exchanger of claim 1, further comprising a refrigerant divider that divides the refrigerant into a plurality of streams and allows the refrigerant streams to flow into the heat transfer tubes being arranged at the multiple levels of the inlet heat exchange unit, wherein the refrigerant divider includes a header having an interior separated by one or more partitions into a plurality of chambers arranged in a longitudinal direction of the heat exchanger and a distributor configured to substantially evenly divide the refrigerant into streams and each of the chambers is connected to the distributor with a capillary tube.

9. The heat exchanger of claim 1, wherein the row straddling header is mounted longitudinally.

10. The heat exchanger of claim 1, wherein each heat transfer tube is a flat tube having a plurality of through-holes that serve as a refrigerant passage.

11. A refrigeration cycle apparatus comprising:

a compressor;

a pressure reducing device; and a heat exchanger, the heat exchanger comprising:

a plurality of heat exchange units each including a plurality of heat transfer tubes through which a refrigerant in a gas-liquid two-phase state flows, and a plurality of fins arranged such that air passes between adjacent fins in an air passing direction, the heat transfer tubes being arranged at multiple levels in a level direction perpendicular to the air passing direction, the heat exchange units being arranged in multiple rows in a row direction, serving as the air passing direction; and a row straddling header in communication with the heat transfer tubes at first ends of the heat transfer tubes, wherein the heat exchange units at opposite ends in the row direction of the heat exchange units arranged in the multiple rows serve as an inlet heat exchange unit into which the refrigerant flows, and an outlet heat exchange unit out of which the refrigerant flows, the inlet heat exchange unit having an inlet header in communication with the heat transfer tubes at second ends of the heat transfer tubes, the inlet header, the heat transfer tubes and an outlet header define refrigerant passages through which the refrigerant flows, and each of the inlet header and the row straddling header has an interior separated into a plurality of chambers arranged in the level direction, each of the refrigerant passages being isolated by corresponding chambers in the inlet header and the row straddling header.

12. An air-conditioning apparatus comprising a refrigeration cycle device including a compressor, a pressure reducing device, and a heat exchanger, the heat exchanger comprising:

a plurality of heat exchange units each including a plurality of heat transfer tubes through which a refrigerant in a gas-liquid two-phase state flows, and a plurality of fins arranged such that air passes between adjacent fins in an air passing direction, the heat transfer tubes being arranged at multiple levels in a level direction perpendicular to the air passing direction, the heat exchange units being arranged in multiple rows in a row direction, serving as the air passing direction; and a row straddling header in communication with the heat transfer tubes at first ends of the heat transfer tubes, wherein the heat exchange units at opposite ends in the row direction of the heat exchange units arranged in the multiple rows serve as an inlet heat exchange unit into which the refrigerant flows and an outlet heat exchange unit out of which the refrigerant flows, the inlet heat exchange unit having an inlet header in communication with the heat transfer tubes at second ends of the heat transfer tubes, the inlet header, the heat transfer tubes and an outlet header define refrigerant passages through which the refrigerant flows, and each of the inlet header and the row straddling header has an interior separated into a plurality of chambers arranged in the level direction, each of the refrigerant passages being isolated by corresponding chambers in the inlet header and the row straddling header.

* * * * *